US010038286B2

(12) United States Patent
Zhu et al.

(10) Patent No.: US 10,038,286 B2
(45) Date of Patent: Jul. 31, 2018

(54) ELECTRICAL CONNECTOR WITH WIRES SOLDERED UPON INTERNAL PRINTED CIRCUIT BOARD AND EMBEDDED WITHIN INSULATOR

(71) Applicant: FOXCONN INTERCONNECT TECHNOLOGY LIMITED, Grand Cayman (KY)

(72) Inventors: Jian-Kuang Zhu, Kunshan (CN); Wei Zhong, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/666,517

(22) Filed: Aug. 1, 2017

(65) Prior Publication Data

US 2018/0034218 A1 Feb. 1, 2018

(30) Foreign Application Priority Data

Aug. 1, 2016 (CN) ..... 2016 1 0618182

(51) Int. Cl.

| | |
|---|---|
| ***H01R 13/648*** | (2006.01) |
| ***H01R 24/60*** | (2011.01) |
| ***H01R 13/6585*** | (2011.01) |
| *H01R 107/00* | (2006.01) |

(52) U.S. Cl.

CPC ..... *H01R 24/60* (2013.01); *H01R 13/6585* (2013.01); *H01R 2107/00* (2013.01)

(58) Field of Classification Search

CPC ..... H01R 13/658; H01R 13/65807; H01R 13/506; H01R 23/662; H01R 23/688; H01R 23/7073; H01R 23/6873

USPC ..... 439/497, 499, 108, 607.05, 579

See application file for complete search history.

(56) References Cited

U.S. PATENT DOCUMENTS

| | | | | |
|---|---|---|---|---|
| 9,281,626 | B2 * | 3/2016 | Lin | H01R 13/6581 |
| 9,318,856 | B2 * | 4/2016 | MacDougall | H01R 13/6581 |
| 9,379,499 | B2 * | 6/2016 | Miyoshi | H01R 24/60 |
| 2014/0024257 | A1 * | 1/2014 | Castillo | H01R 13/6585 439/607.05 |

FOREIGN PATENT DOCUMENTS

CN 104577442 A 4/2015

* cited by examiner

*Primary Examiner* — Hien Vu

(74) *Attorney, Agent, or Firm* — Wei Te Chung; Ming Chieh Chang

(57) ABSTRACT

A first terminal module and a second terminal module are integrally assembled with the base, and each of the first terminal module and the second terminal module includes the insulator and the corresponding terminals embedded therein. The first terminal module and the second terminal module are stacked with each other with a metallic shielding plate therebetween. A plurality of wires are located behind the first and second terminal modules. An internal printed circuit board is located between the terminals and the wires in the front-to-back direction to respectively connect to the terminals and the wires. Each of the terminal modules is equipped with a metallic grounding bar connected to the printed circuit board and the wires.

11 Claims, 10 Drawing Sheets

ELECTRICAL CONNECTOR WITH WIRES SOLDERED UPON INTERNAL PRINTED CIRCUIT BOARD AND EMBEDDED WITHIN INSULATOR

BACKGROUND OF THE DISCLOSURE

1. Field of the Disclosure

The invention is related to an electrical cable connector, and particularly to the cable connector equipped with a shielding plate between two rows of cables and an internal printed circuit board. The instant application is related to a copending application having the same applicant, the same inventors, the same assignee and the same filing date with a title of "ELECTRICAL CONNECTOR WITH WIRES SOLDERED UPON CONTACT TAILS AND EMBEDDED WITHIN INSULATOR"

2. Description of Related Arts

China Patent No. 203747078 discloses an electrical connector including a metallic shell and a contact module assembled within the shell wherein the shell includes a main part and a mating part forwardly extending from the main part. The contacts extend beyond the contact module and the shell to be connected with the corresponding wires. Because the wires are connected to the contacts outside of the connector, thus tending to loosen the connection between the wires and the contacts and increase the lengthwise dimension of the whole connector.

It is desired to provide an improved connector with the reliable connection between the wires and the contacts with a minimized dimension in the front-to-back direction.

SUMMARY OF THE DISCLOSURE

To achieve the above desire, an electrical cable connector includes a base, a plurality of terminals and a plurality of wires. The base includes a main body and a mating tongue extending forwardly from the main body. The mating tongue includes opposite mating faces. The terminal includes a front contacting section exposed upon the mating face, and a rear connecting section rearwardly extending from the front contacting section. A plurality of wires are located behind the contacts in the front-to-back direction. An internal printed circuit board is located between the contacts and the wires in the front-to-back direction wherein the rear connecting sections are mechanically and electrically connected to front conductive pads on the internal printed circuit board and the conductors of the wires are mechanically and electrically connected to the rear conductive pads on the printed circuit board. A metallic shielding plate is integrally formed within the base with an opening to receive the internal printed circuit board therein. The base, the terminals and the wires are unified together via two-stage insert-molding process.

DETAILED DESCRIPTION OF THE PREFERRED EMBODIMENT

Figure 1:
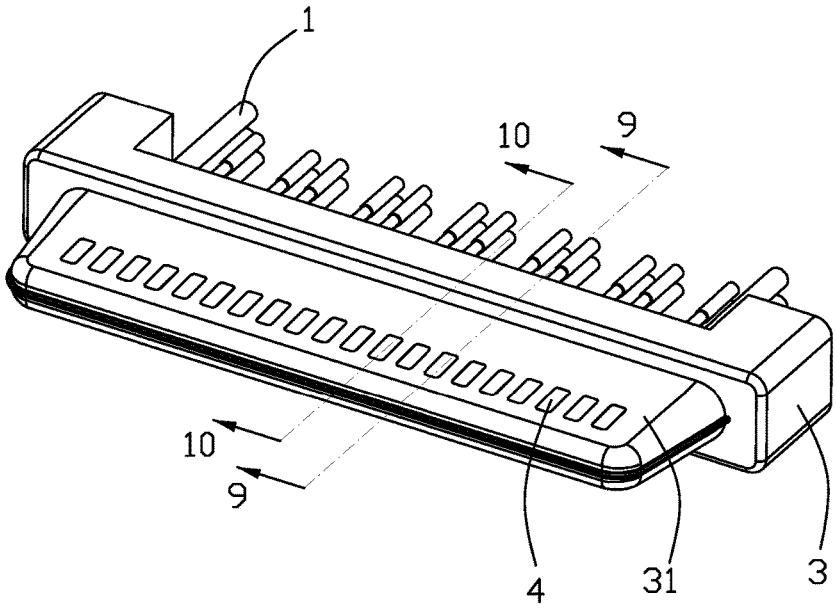
FIG. 1 is a perspective view of an electrical cable connector of the invention according to the invention.
Figure 2:
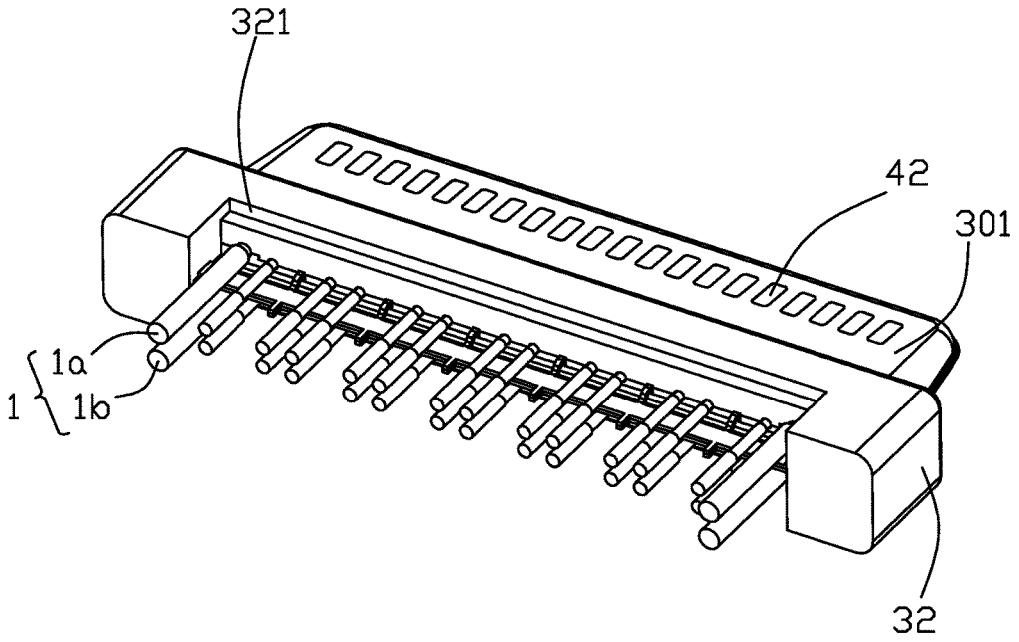
FIG. 2 is another perspective view of the electrical cable connector of FIG. 1.
Figure 3:
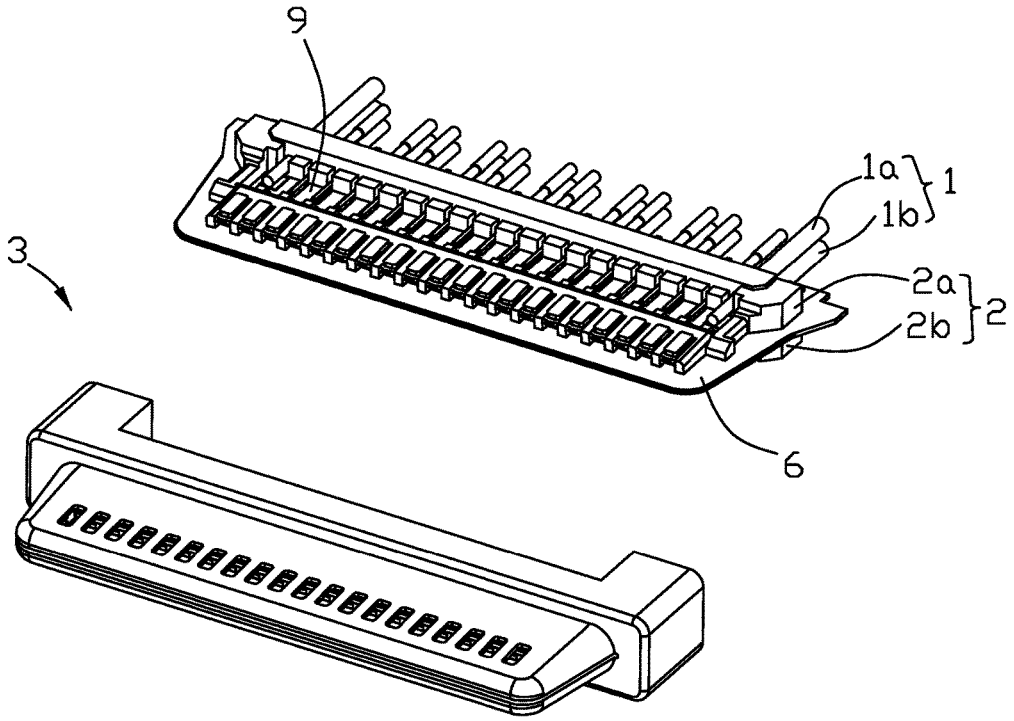
FIG. 3 is an exploded perspective view of the electrical cable connector of FIG. 1.
Figure 4:
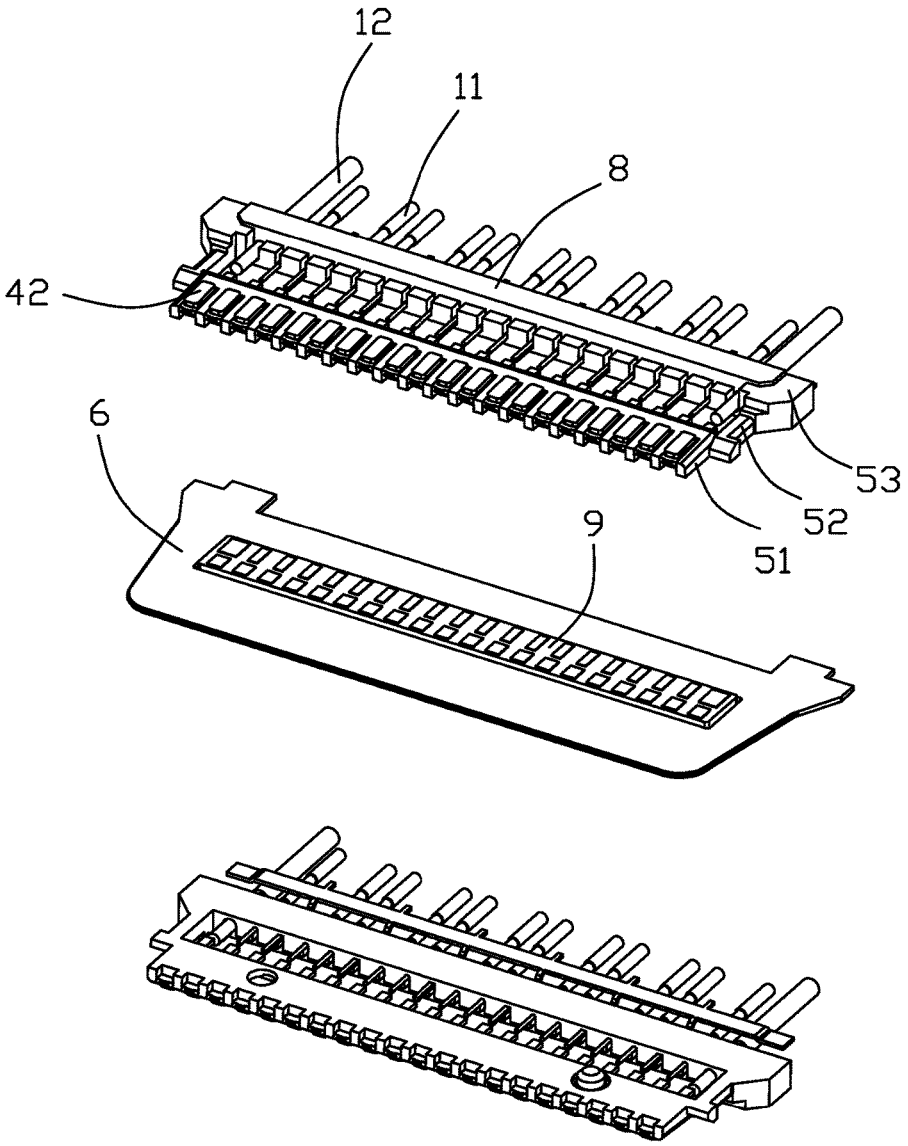
FIG. 4 is a further exploded perspective view of the contact module of the electrical cable connector of FIG. 3.
Figure 5:
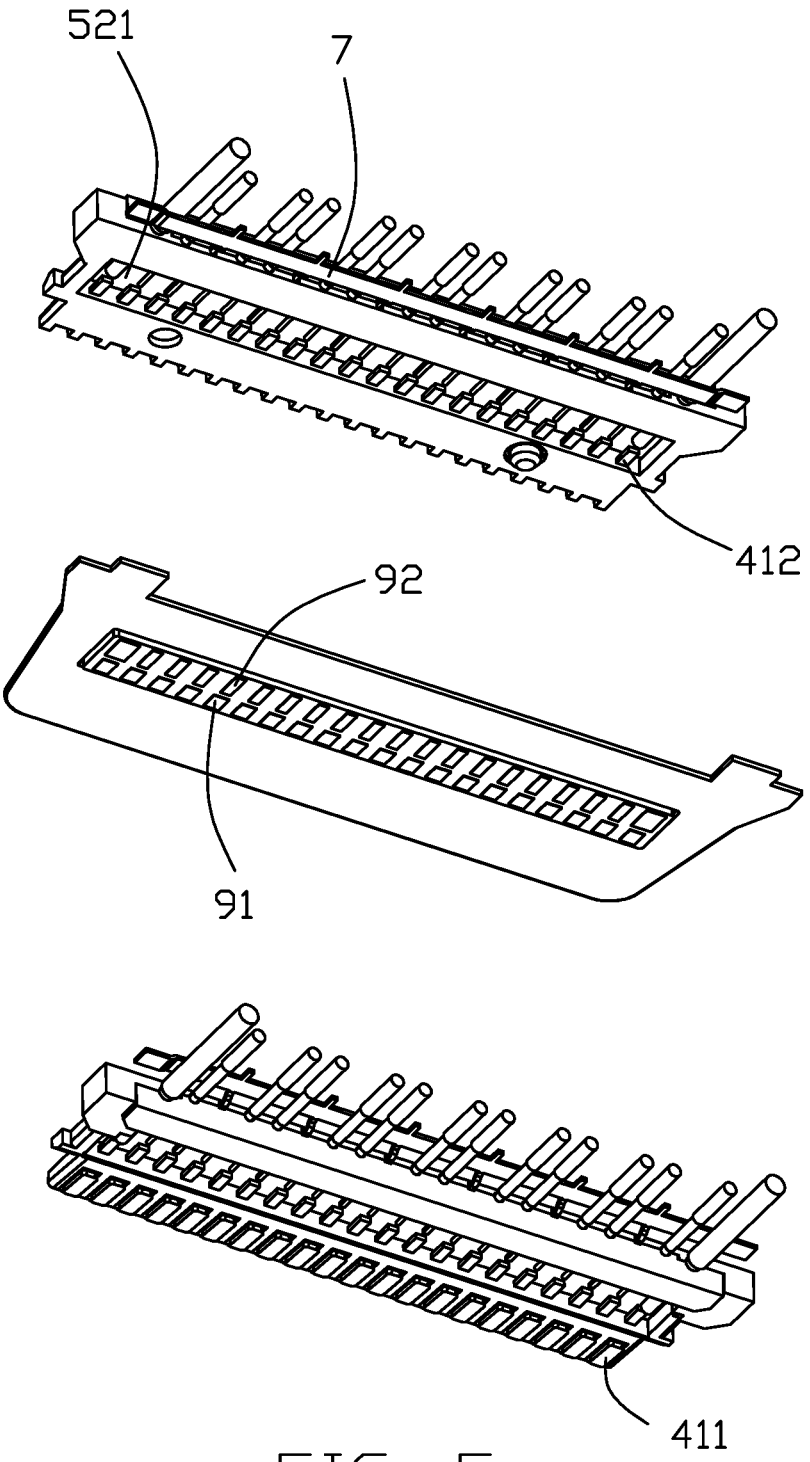
FIG. 5 is another exploded perspective view of the contact module of the electrical cable connector of FIG. 4.
Figure 6:
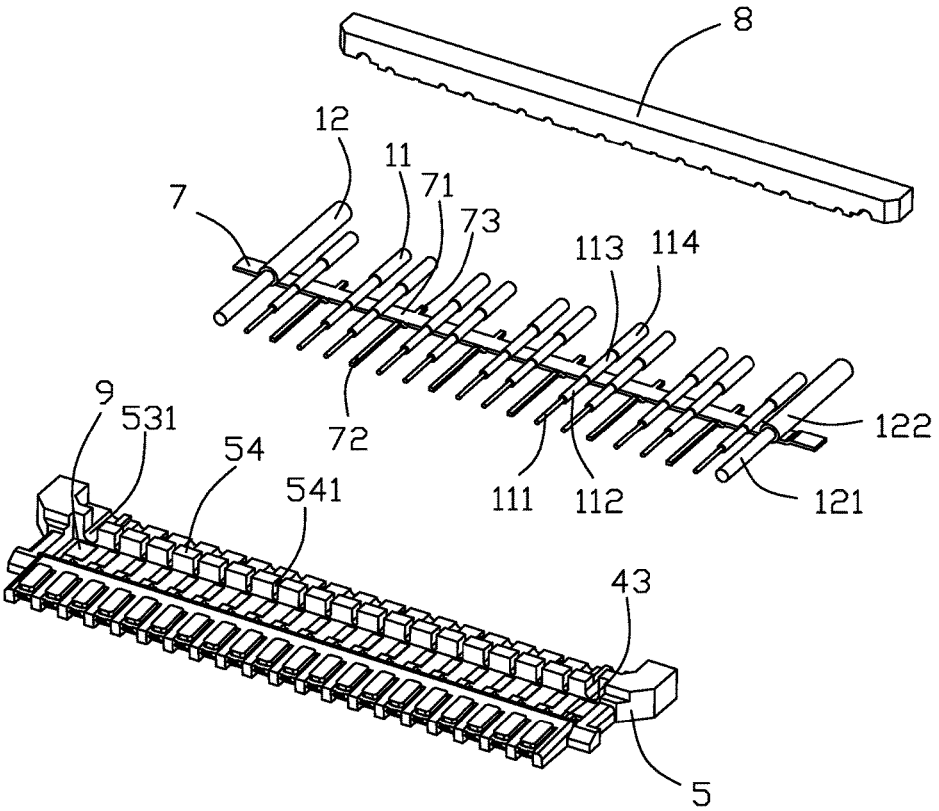
FIG. 6 is an further exploded perspective view of the upper terminal module of the contact module of the electrical cable connector of FIG. 4.
Figure 7:
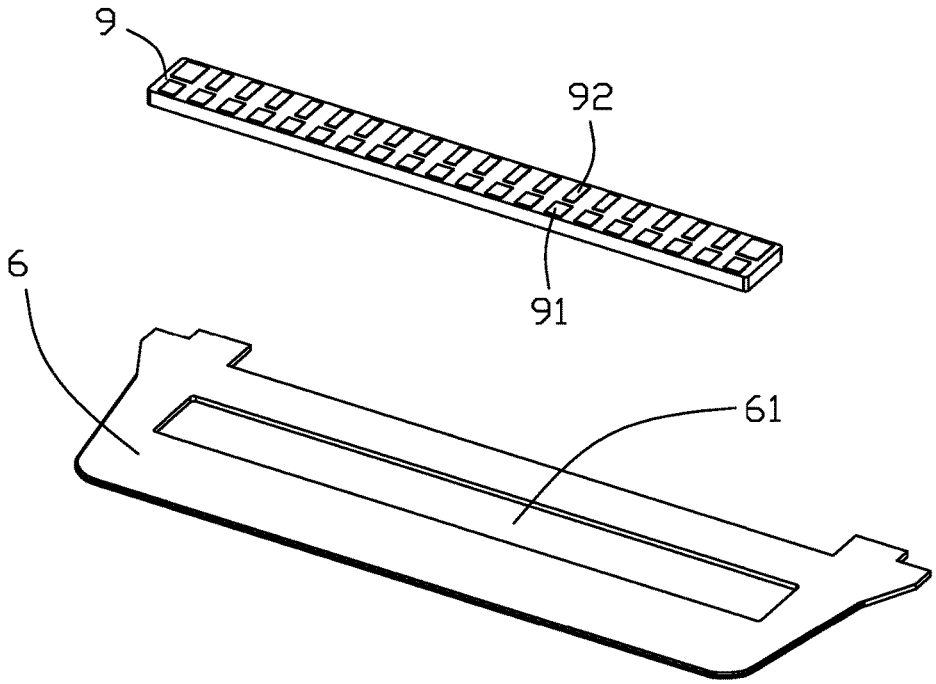
FIG. 7 is an exploded perspective view of the internal printed circuit board and the associated shielding plate of the contact module of the electrical cable connector of FIG. 6.
Figure 8:
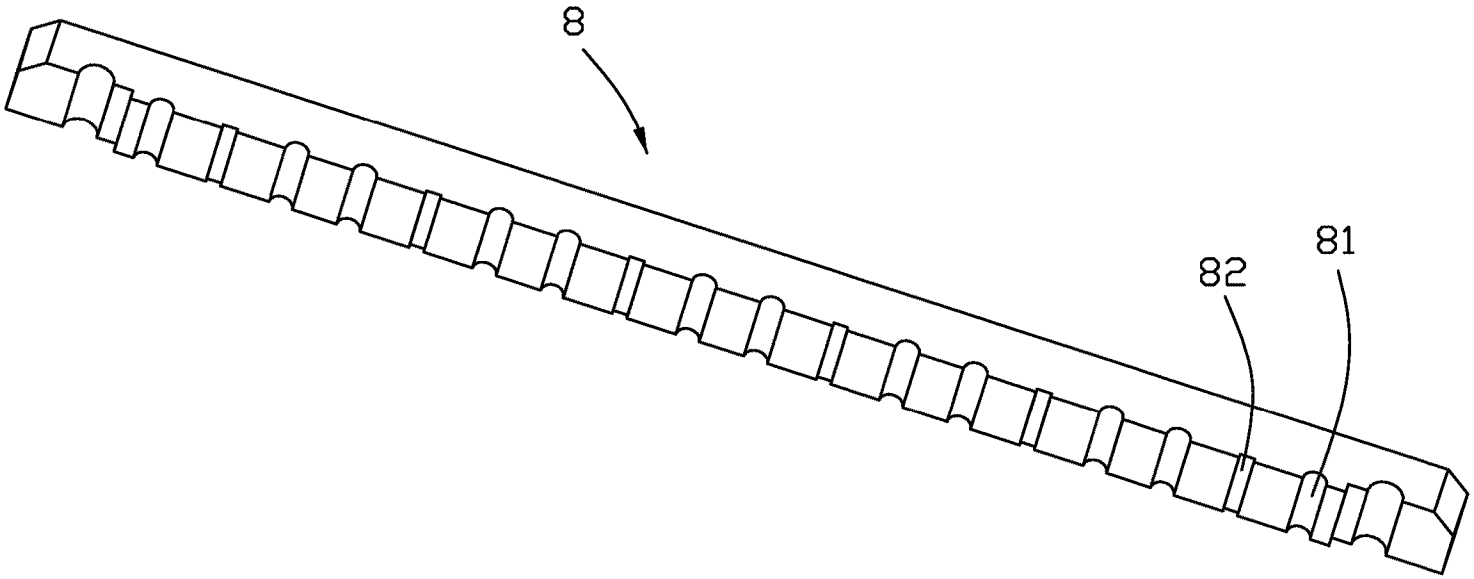
FIG. 8 is an enlarged partial perspective view of the pressing block of the upper terminal module of the electrical cable connector of FIG. 6.
Figure 9:
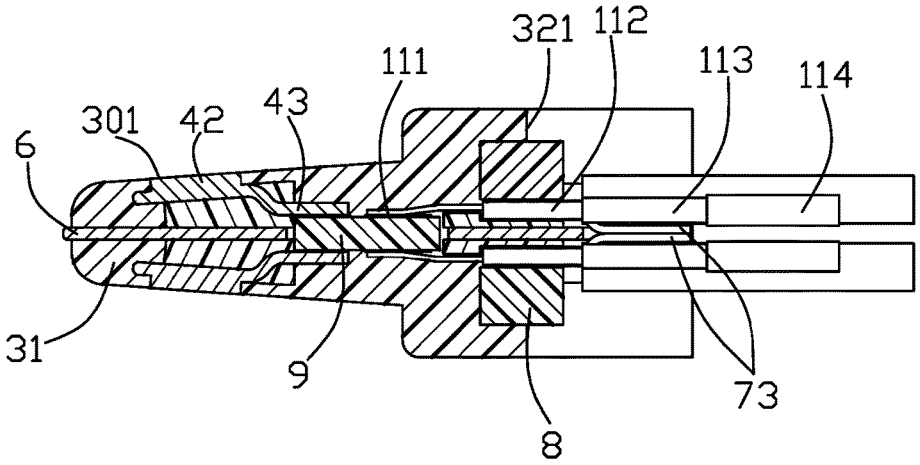
FIG. 9 is a cross-sectional view of the electrical cable connector of FIG. 1.
Figure 10:
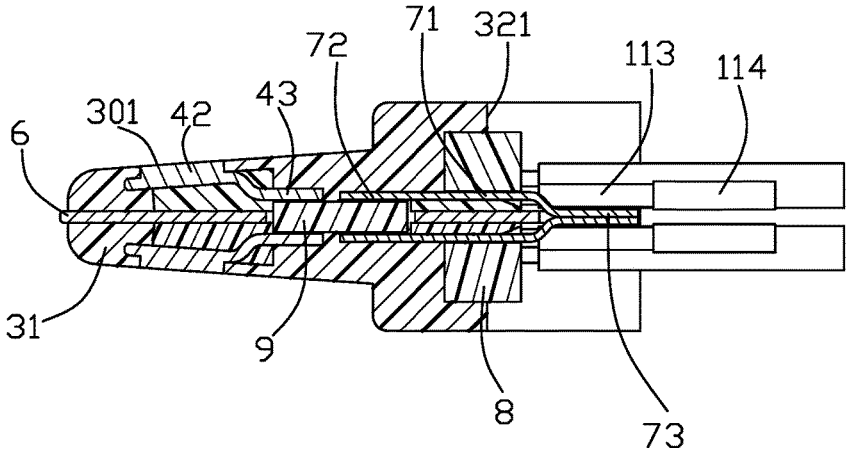
FIG. 10 is another cross-sectional view of the electrical cable connector of FIG. 1.

Reference will now be made in detail to the embodiments of the present disclosure. Referring to FIGS. 1-10, an electrical cable connector 100 includes an insulative base 3, a plurality of terminals 4, a plurality of wires 1 and a internal printed circuit board 9 connected between the corresponding terminals 4 and the wires 1. The base 3 includes a main body 32 and a mating tongue 31 forwardly extending from the main body 32. The mating tongue 31 includes opposite mating faces 301. The terminals are insert-molded within the insulative material to form a contact module 2 which includes an upper terminal module 2*a* and a lower terminal module 2*b* to commonly sandwich a metallic shielding plate 6 wherein the contact module 2 cooperates with the wires 1 to be further insert-molded or over-molded to form the insulative base 3.

The upper terminal module 2*a* and the lower terminal module 2*b* have the similar configuration so the following description is generally based upon the upper terminal module 2*a*. Notably, the upper wires 1*a* and the lower wires 1*b* correspond to the upper terminal module 2*a* and the lower terminal module 2*b*.

The upper terminal module 2*a* includes a row of terminals 4, an insulator integrally formed with the terminals 4, a grounding bar 7 to retain the corresponding wires 1*a*, and a pressing block 8. The insulator 5 having three stepped structure, includes a first section 51, a second section 52 and a third section 53. The terminal 4 includes a front plate 411 embedded in the first section 51, and a rear plate 412 extending rearwardly from the front plate 411 with an offset section therebetween. The front plate 411 includes a front contacting section 42 exposed upon the surface of the first section 51 while the rear plate 412 includes a rear connecting section 43 mechanically and electrically connected to the internal printed circuit board 9. A receiving slot 521 is formed in the second section 51 for receiving an upper half of the printed circuit board 9. The connecting section 43 is exposed in the receiving slot 521. A plurality of passageways 531 are formed in the third section 53 for receiving the wires 1. A abutment section 54 is located between the third section 53 and the second section 52 and forms a plurality of notch 541 aligned with the corresponding receiving grooves, respectively, so as to allow each wire 1 to extend through the passageways 531 and the corresponding notches 541 to be connected to the printed circuit board 9.

The wires 1 includes a plurality of signal wires 11 and a plurality of power wires 12. The signal wire 11 is a co-axial wire while the power wire 12 has a single inner conductor. In this embodiment, the wires 11 arranged in one row, have two power wires 12 at two opposite ends and the signal wires 11 therebewteen. The signal wire 11 includes an inner conductor 111, an inner insulator 112 surrounding the conductor 111, a metallic braiding layer 113 surrounding the inner insulator 112, and an outer insulator 114 surrounding the braiding layer 113 in a concentric manner. Front end sections of the conductor 111, the inner insulator 112, the braiding layer 113 and the outer insulator 114 are respectively exposed to an exterior in sequence. The power wire 12 includes a conductor 121 and an insulator 122 surrounding the conductor 121. The power wires 12 are connected to the power terminals of the terminal module via the corresponding pads on the internal printed circuit board 9, and the signal wires 11 are connected to the signal terminals of the terminal module via the corresponding pads on the internal printed circuit board 9. The grounding terminals 4G are commonly grounded by the grounding bar 7 via the corresponding pads on the printed circuit board 9.

The grounding bar 7 includes a main body 71, a plurality of first arms 72 extending forwardly from the main body 71, and a plurality of second arms 73 extending rearwardly from the main body 71 and aligned with the corresponding first arms 72 in the front-to-back direction, respectively. The grounding bar 7 is located between the wires 1 and the shielding plate 6, and the braiding layers 113 of the wires 1 are soldered upon the main body 71. The first arms 72 extend forwardly between the wires 1 transmitting signals, and is terminated at a position similar to the conductor 111, and positioned upon the printed circuit board 9. The upper wires 1*a* and the corresponding grounding bar 7 are assembled to the insulator 5 of the upper terminal module 2*a* so as to have the first arms 72 are electrically connected to the corresponding grounding terminals 4G via the printed circuit board 9 while the second arms 73 are exposed outside of the contact module 2.

After the wires 1 and the grounding bar 7 are assembled to the corresponding insulator 5, the pressing block 8 is assembled successively. The pressing block 8 is made of insulative material and assembled upon the third section 53 to cooperate with the third section 53 to sandwich the wires 1 therebetween. The pressing block 8 includes the receiving slots 81, 82 corresponding to the passageways 531 to receive the corresponding wires 1 and the first arms 72. Notably, the passageways 531 and the corresponding receiving slots 81 both of which receive the corresponding wires 1, are configured to be semi-circular while those for receiving the corresponding first contact 72 are configured to be rectangular.

The shielding plate 6 includes an opening 61 to receiving the printed circuit board 9 therein. The printed circuit board 9 has two opposite upper and lower surfaces each having front conductive pads 91 and rear conductive pads 92. The conductors 111 and 121 are connected to the rear pads 92 while the connecting sections 43 of the terminals 4 are connected to the front pads 91. The printed circuit board 9 extends through the opening 61 into the corresponding receiving slot 521 of the respective terminal module 2*a*, 2*b*.

Via a second stage insert-molding or over-molding process, an insulative material is applied upon the contact module 2 and the associated wires 1 to form an insulative base 3 so as to complete the whole connector 100. The base 3 includes a rear face 321. The contacting sections 42 are exposed upon the mating surface 301 in a flush manner, the connecting sections 43 are soldered upon the front pads 91, and the conductors 111 are soldered upon the rear pads 92. The exposed conductors 111 are essentially located within the base 3, the inner insulators 112 are located behind the exposed conductors 111 and within the base 3, the braiding layers 113 are located behind a rear face 321 of the base 3. The main body 71 including the second arms 73 of the grounding bar 7 of the upper terminal module 2*a* are connected to those of the lower terminal module 2*b* in the vertical direction and perform good grounding effect through the corresponding grounding terminals 4G. The pressing block 8 presses the inner insulators 112 to efficiently hold the wires 1 in position.

The method of making the instant connector includes steps as follows: (1) providing the upper terminal module 2*a* and the lower terminal module 2*b* each including an insulator 5 with a one row of terminals 4 via an insert-molding process wherein each terminal 4 includes a front contacting section 42 and a rear contacting section 42 both exposed upon a surface of the insulator 5; (2) providing two rows of wires each including signal wires 11 and power wires 12; (3) providing two grounding bars 7 each located outside of the corresponding insulator 5 and vertically inside the corresponding wires 1 with the braiding layer 113 of the corresponding signal wires 11 soldered thereon; (4) providing a metallic shielding plate 6 with an internal printed circuit board 9 sandwiched between the upper terminal module 21 and the lower terminal module 2*b* to form a sub-assembly wherein the connecting sections 43 are connected to the front pads 91 of the printed circuit board 9; (5) assembling the wires 1 with the associated grounding bar 7 upon the corresponding terminal module 2*a*, 2*b* by means of the pressing block 8 wherein the inner conductor 111 of the signal wires are connected to the rear pads 92 of the printed circuit board 9 as well as the first arms 72 of the grounding bar 7, and the main body 71 of the grounding bar 7 of the upper terminal module 2*a* abuts against that of the lower terminal module 2*b*; and (6) applying an insulative material upon an exterior of such a sub-assembly via an over-molding process to further cover front ends of the wires 1 so as to form the base 3 with the mating tongue 32 for finalizing the contour of the connector 100 wherein the contacting sections 42 of the terminals 4 are exposed upon the mating faces 301 of the mating tongue 32 while the connecting sections 43, the first arms 72, and the conductor 111 of the wires are embedded within the insulative base 3.

While a preferred embodiment in accordance with the present disclosure has been shown and described, equivalent modifications and changes known to persons skilled in the art according to the spirit of the present disclosure are considered within the scope of the present disclosure as described in the appended claims.

What is claimed is:

1. An electrical cable connector comprising:

a contact module including a pair of terminal modules commonly sandwiching a metallic shielding plate therebetween in a vertical direction; each of said terminal modules including an insulator and a plurality of terminals disposed in the insulator, said terminals being categorized with grounding terminals and paired signal terminals alternately arranged with each other along a transverse direction perpendicular to said vertical direction, each of said terminals including a front contacting section and a rear connecting section along a front-to-back direction perpendicular to both said vertical direction and said transverse direction; and a plurality of signal wires located behind the contact module, each of the wires including an inner conductor, an inner insulator, a metallic braiding layer and an outer insulator concentrically arranged with one another in sequence radially and exposed with corresponding front end regions in order along the front-to-back direction;

wherein in each of said terminals, the front contacting section is farther from the metallic shielding plate than the corresponding rear connecting section is in the vertical direction;

wherein the metallic shielding plate forms an opening to receive an internal printed circuit board therein, the connecting sections are connected to front pads of the internal printed circuit board while the conductors are connected to rear pads of the internal printed circuit board;

wherein each of said terminal modules is further equipped with a metallic grounding bar mechanically and electrically connected to the braiding layers of the signal wires;

wherein grounding bar includes a plurality of forwardly extending first arms mechanically and electrically connected to the rear pads of the printed circuit board;

wherein said grounding bars of said pair of terminal modules abuts against each other in the vertical direction; and wherein the insulator of each of said terminal modules forms a receiving slot to receive one half of the printed circuit board in the vertical direction.

2. The electrical cable connector as claimed in claim 1, wherein each of said terminal modules further includes an insulative pressing block cooperating with the corresponding insulator to commonly sandwich the corresponding signal wires therebetween in the vertical direction.

3. The electrical cable connector as claimed in claim 2, wherein the pressing block is integrally secured with an insulative base which is applied to the contact module via an overmolding process.

4. The electrical able connector as claimed in claim 3, wherein the insulative base covers the inner conductors of the wires and the connecting sections of the corresponding terminals, and the internal printed circuit board.

5. The electrical cable connector as claimed in claim 2, wherein the pressing block presses the exposed front end region of the inner insulator.

6. The electrical cable connector as claimed in claim 5, wherein the pressing block and the corresponding insulator respectively form a plurality of passageways and corresponding notches to commonly receptively sandwich the exposed inner insulators of the corresponding wires in the vertical direction.

7. An electrical cable connector comprising:

a contact module including a pair of terminal modules commonly sandwiching a metallic shielding plate therebetween in a vertical direction; each of said terminal modules including an insulator and a plurality of terminals disposed in the insulator, said terminals being categorized with grounding terminals and paired signal terminals alternately arranged with each other along a transverse direction perpendicular to said vertical direction, each of said terminals including a front contacting section and a rear connecting section along a front-to-back direction perpendicular to both said vertical direction and said transverse direction; and a plurality of paired signal wires located behind the contact module, each of the wires including an inner conductor, an inner insulator, a metallic braiding layer and an outer insulator concentrically arranged with one another in sequence radially with corresponding exposed front end regions in order along the front-to-back direction;

wherein the metallic shielding plate forms an opening to receive an internal printed circuit board therein, the connecting sections are connected to front pads of the internal printed circuit board while the conductors are connected to rear pads of the internal printed circuit board;

wherein an insulative base is applied upon the pair of terminal modules to cover the inner conductors via an over-molding process;

wherein each of said terminal modules further includes a grounding bar having a plurality of forwardly extending arms connected to the corresponding rear pads of the printed circuit board;

wherein said grounding bars of said pair of terminal modules are mechanically and electrically connected to each other; and wherein the insulator of each of said terminal modules forms a receiving slot to receive one half of the printed circuit board in the vertical direction.

8. The electrical cable connector as claimed in claim 7, wherein the braiding layers of the signal wires are mechanically and electrically connected to the grounding bar.

9. The electrical cable connector as claimed in claim 7, wherein each of said terminal modules further includes an insulative pressing block cooperating with the corresponding insulator to commonly sandwich the corresponding signal wires therebetween in the vertical direction.

10. An electrical cable connector comprising:

a contact module including a pair of terminal modules commonly sandwiching a metallic shielding plate therebetween in a vertical direction; each of said terminal modules including an insulator and a plurality of terminals disposed in the insulator, said terminals being categorized with grounding terminals and paired signal terminals alternately arranged with each other along a transverse direction perpendicular to said vertical direction, each of said terminals including a front contacting section and a rear connecting section along a front-to-back direction perpendicular to both said vertical direction and said transverse direction;

a plurality of signal wires located behind the contact module, each of the wires including an inner conductor, an inner insulator, a metallic braiding layer and an outer insulator concentrically arranged with one another in sequence; and an internal printed circuit board located between the wires and the terminals in the front-to-back direction, the connecting sections connected to front pads of the printed circuit board while the conductors are connected to rear pads of the printed circuit board;

wherein each of said terminal modules is further equipped with a metallic grounding bar mechanically and electrically connected to the braiding layers of the signal wires;

wherein a metallic shielding plate forms an opening to receive the internal printed circuit board therein, the connecting sections are connected to front pads of the internal printed circuit board while the conductors are connected to rear pads of the internal printed circuit board;

wherein the grounding bar includes a plurality of forwardly extending arms mechanically and electrically connected to the corresponding rear pads on the printed circuit board and located beside the signal wires; and wherein the insulator of each of said terminal modules forms a receiving slot to receive one half of the printed circuit board in the vertical direction.

11. The electrical cable connector as claimed in claim 10, wherein each of said terminal modules further includes an insulative pressing block cooperating with the corresponding insulator to commonly sandwich the corresponding signal wires therebetween in the vertical direction.

* * * * *